US009804615B2

(12) United States Patent
Chern et al.

(10) Patent No.: US 9,804,615 B2
(45) Date of Patent: Oct. 31, 2017

(54) LOW POWER BIAS SCHEME FOR MOBILE STORAGE SOC

(71) Applicant: SK hynix memory solutions inc., San Jose, CA (US)

(72) Inventors: Jenn-Gang Chern, Redwood City, CA (US); Mao-Ter Chen, San Jose, CA (US)

(73) Assignee: SK Hynix Memory Solutions Inc., San Jose, CA (US)

( * ) Notice: Subject to any disclaimer, the term of this patent is extended or adjusted under 35 U.S.C. 154(b) by 8 days.

(21) Appl. No.: 14/877,829

(22) Filed: Oct. 7, 2015

(65) Prior Publication Data

US 2016/0103459 A1 Apr. 14, 2016

Related U.S. Application Data

(60) Provisional application No. 62/063,262, filed on Oct. 13, 2014.

(51) Int. Cl.
*G05F 1/46* (2006.01)
*G05F 1/575* (2006.01)
*G05F 1/56* (2006.01)

(52) U.S. Cl.
CPC ..... *G05F 1/468* (2013.01)

(58) Field of Classification Search
CPC ..... G05F 1/468; G05F 1/461; G05F 1/575; G05F 1/56
See application file for complete search history.

(56) References Cited

U.S. PATENT DOCUMENTS 6,236,194 B1 * 5/2001 Manabe ..... G05F 1/565 323/274
7,531,852 B2 * 5/2009 Ueda ..... H01L 29/8611 257/203
7,652,455 B2 * 1/2010 Demolli ..... G05F 1/575 323/270
9,190,988 B1 * 11/2015 Gupta ..... H03K 17/22
9,209,814 B2 * 12/2015 Matsuo ..... H03K 3/0231
2004/0155636 A1 * 8/2004 Fukui ..... G05F 1/56 323/281
2009/0231025 A1 * 9/2009 Wang ..... G05F 1/56 327/543
2012/0153910 A1 * 6/2012 Bulzacchelli ..... G05F 1/575 323/272
2013/0015828 A1 * 1/2013 Amir ..... G05F 1/565 323/281
2013/0147271 A1 * 6/2013 Yotsuji ..... H02J 4/00 307/28
2013/0169246 A1 * 7/2013 Shao ..... G05F 1/563 323/266

* cited by examiner

*Primary Examiner* — Timothy J Dole
*Assistant Examiner* — Sisay G Tiku
(74) *Attorney, Agent, or Firm* — IP & T Group LLP

(57) ABSTRACT

A voltage regulator, an active circuit, and a passive circuit is used. The active circuit is used to supply a reference signal as an input to the voltage regulator during a higher power mode. The passive circuit is used to supply a second reference signal as the input to the voltage regulator during a lower power mode, wherein the lower power mode consumes less power than the higher power mode.

17 Claims, 7 Drawing Sheets

LOW POWER BIAS SCHEME FOR MOBILE STORAGE SOC

CROSS REFERENCE TO OTHER APPLICATIONS

This application claims priority to U.S. Provisional Patent Application No. 62/063,262 entitled LOW POWER BIAS SCHEME FOR MOBILE STORAGE SOC filed Oct. 13, 2014 which is incorporated herein by reference for all purposes.

BACKGROUND OF THE INVENTION

For many computer applications, a sleep mode is available to reduce power consumption for the computer's circuits. There is a need to decrease power consumption when a computer is in sleep mode.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Further reducing power consumption in sleep mode with a simpler voltage reference bias scheme is disclosed.

In a typical system-on-chip (SOC), for example an embedded Multi-Media Controller (eMMC) for mobile, sleep mode power consumption is important as it affects the system's battery life. During a system's sleep mode, certain elements of digital logic need to remain powered, for example to monitor when to awaken.

In a typical SOC, core logic runs on a much lower voltage than the periphery, based at least in part on process technology advancements. This low voltage may either be provided by an external regulator or an on-chip regulator. In one embodiment, the low voltage for core logic is arranged by the eMMC SOC.

For a regulator to work properly, there exists a need to have a voltage reference generation circuit. Traditionally, a bandgap circuit is typically used as the reference generation, thanks to its accuracy.

Figure 1:
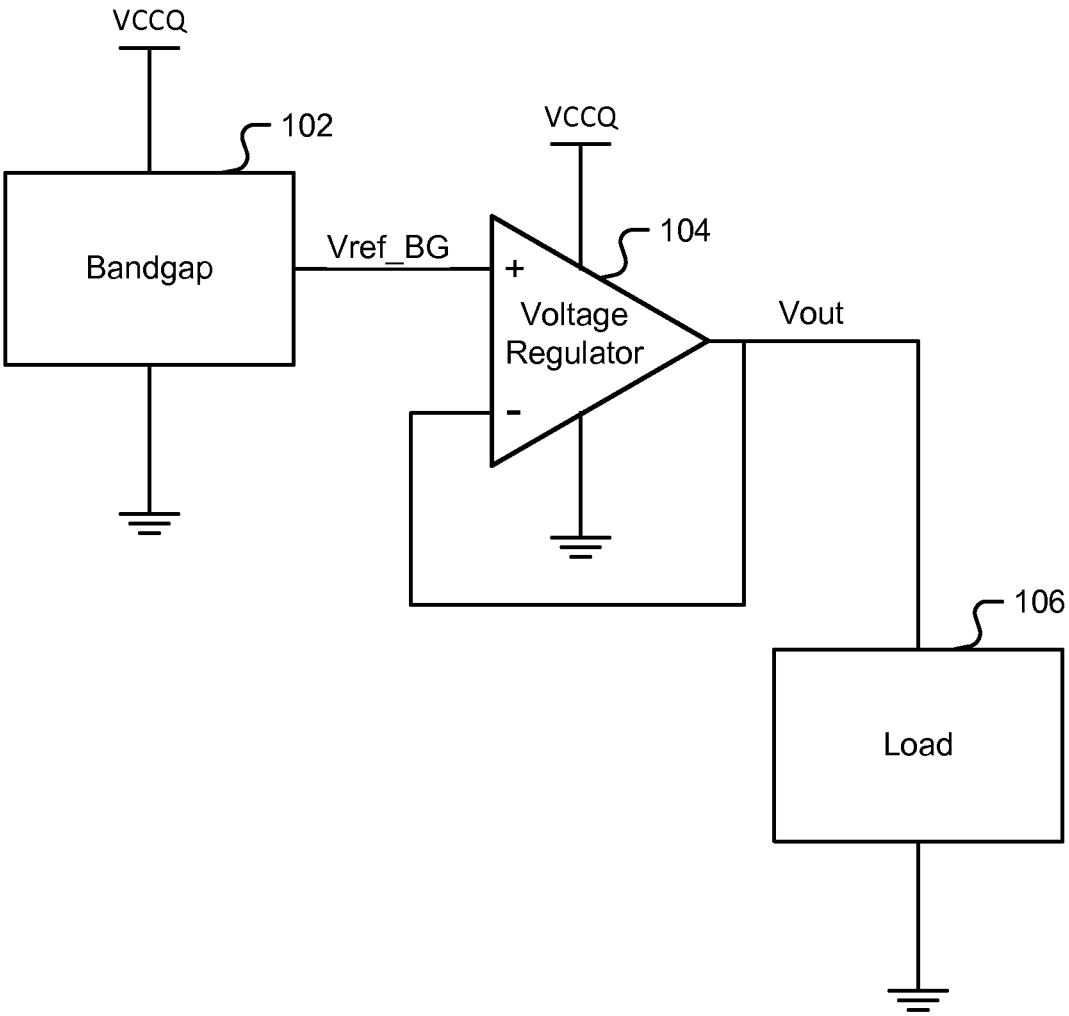
FIG. 1 is a block diagram illustrating a traditional bandgap circuit bias scheme.

FIG. 1 is a block diagram illustrating a traditional bandgap circuit bias scheme. Bandgap circuit (102) is a temperature independent voltage reference circuit that provides a consistent voltage Vref_BG independent of temperature changes, circuit load, and power supply variations, wherein the consistent voltage Vref_BG may be based on the bandgap of silicon at 0K. Bandgap circuit (102) has a relatively high power consumption rate due to its complexity. Bandgap circuit (102) is powered by VCCQ power supply, for example based on a battery source, and is grounded to common ground.

Bandgap circuit (102) is coupled to the input of voltage regulator (104), also powered by VCCQ and grounded to common ground, and may be in one embodiment based on an operational amplifier (op-amp) design. The output of voltage regulator (106) is a consistent Vout voltage that powers the load (106), for example a SOC core voltage.

In the traditional scheme, the bandgap (102) is designed such that its output, Vref_BG, is relatively insensitive to its supply voltage, VCCQ, with the tradeoff that VCCQ is designed to be sufficiently high for the bandgap (102) to work properly. The regulator (104) output, Vout, is also designed such that it is also relatively insensitive to the level of VCCQ, with the tradeoff that the bandgap (102) be stable and that VCCQ is high enough for both bandgap (102) and the regulator (104) to work properly.

While the accuracy of Vout from regulator (104) is good, there is a power penalty for the use of a bandgap (102), due to the complexity of the design, which typically requires several current branches, a startup circuit, and other circuit components.

A simpler bias scheme is disclosed wherein the sleep mode power consumption is reduced, wherein the sleep mode power consumption is based at least in part on the voltage reference bias scheme power consumption. Low power consumption in sleep mode is particularly critical, for example some operating systems will hibernate to sleep mode when battery power is running low. Thus, a much simpler scheme to generate the reference voltage during the sleep mode is disclosed.

Figure 2:
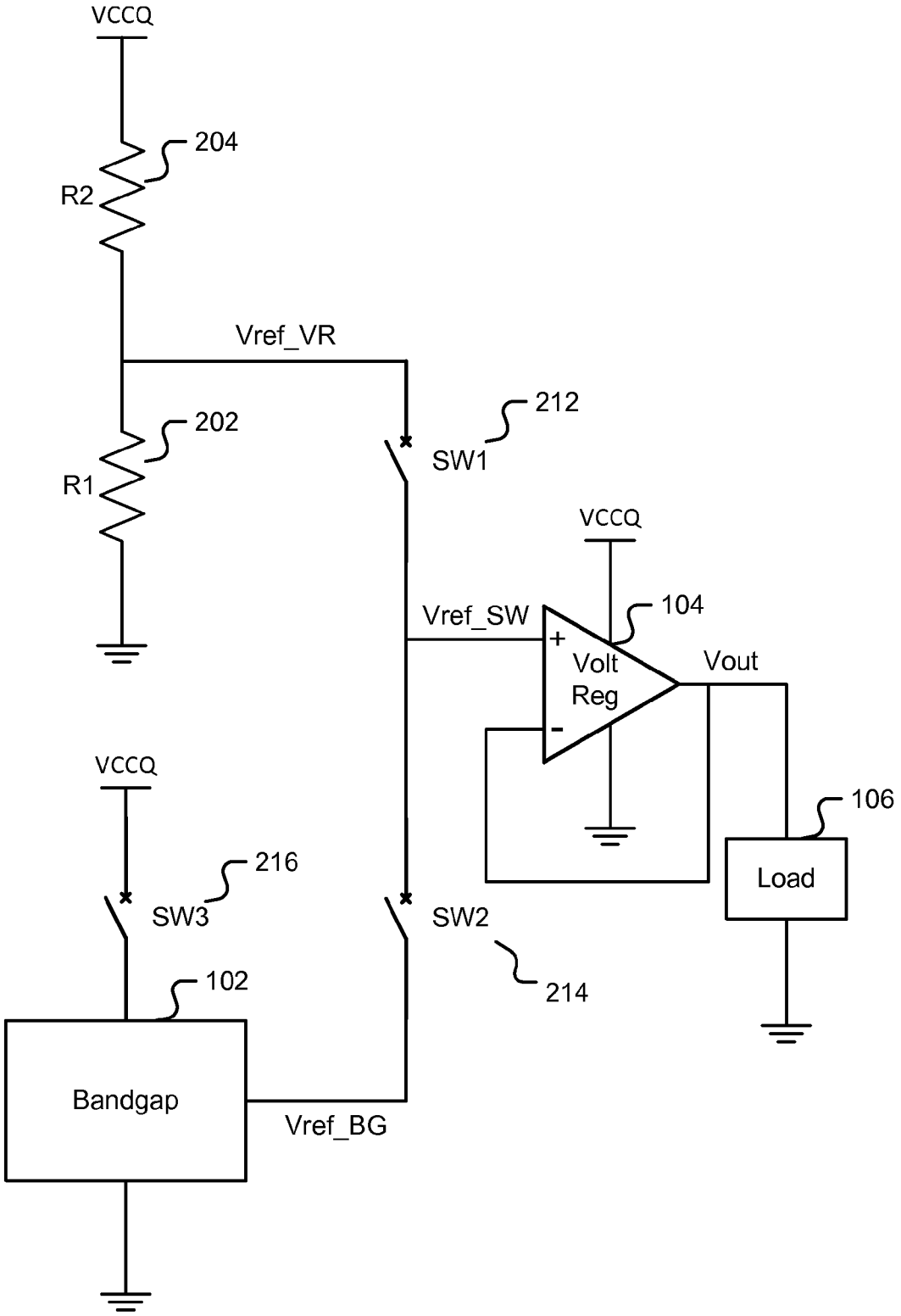
FIG. 2 is a block diagram illustrating an embodiment of a system for a low power bias scheme.

FIG. 2 is a block diagram illustrating an embodiment of a system for a low power bias scheme. FIG. 2 includes essentially the same bandgap bias scheme as that shown in FIG. 1 including bandgap (102), voltage regulator (104), and load (106).

FIG. 2 also includes a lower power bias circuit in which the reference voltage Vref_VR is generated via a passive and/or resistive divider, consisting of resistance R1 (202) and resistance R2 (204) powered by VCCQ and commonly grounded. In one embodiment and without loss of generality, switches are used to select between the higher power bandgap (102) bias circuit or the lower power passive bias circuit (202)/(204), and in the example shown in FIG. 2, switch SW1 (212) and SW2 (214) illustrate this purpose. Thus the input to the voltage regulator (104), Vref_SW, is either Vref_BG from the bandgap (102) bias circuit or Vref_VR from the passive bias circuit (202)/(204). A technique is also used, for example as a switch SW3 (216) shown in FIG. 2, of powering down or otherwise eliminating power consumption from bandgap (102)

The electrical current required for this reference generator is:

$$I_{ref} = \frac{VCCQ}{R1 + R2} \tag{1}$$

The output voltage is:

$$V_{ref} = \frac{VCCQ \cdot R1}{R1 + R2} = VCCQ \cdot \left(1 - \frac{R2}{R1}\right) \tag{2}$$

As demonstrated in equation (1), the power consumption may be managed by changing R1+R2, and as demonstrated in equation (2), the output voltage may be scaled by altering R2/R1.

The accuracy of Vref_VR is directly proportional to the accuracy of VCCQ, which is typically equal or better than ±10%. A sleep mode power supply typically powers housekeeping logic, which i) typically runs at low speeds; and ii) is typically logic designed with standard-cell libraries, thus housekeeping logic may tolerate±10% supply variations. In one example, an eMMC uses housekeeping logic around 400 kHz with a tolerance of ±200 mV, as compared with an active mode at 200 MHz.

By contrast, when the SOC is in the active mode, the powered circuitry may require a more accurate reference voltage for other functions, such as VCC level detection, IO calibration, and so forth. However, when the SOC is the active mode, current consumption budgets are typically less conservative and the convectional bandgap (102) can be used.

As well, while the initial accuracy depends on the external power supply VCCQ, it is possible to improve the accuracy through an optional subsequent calibration, for example when the system is not in sleep mode. There would still be no power penalty associated with such a calibration enhancement in sleep mode.

In one embodiment, to integrate both (i) a lower power mode, such as sleep mode, and (ii) a higher power mode, such as the active mode requirements, switches are used. Throughout this specification, a higher power mode, such as those during active mode, is defined as any power mode that requires more power consumption than a lower power mode, such as sleep mode.

In one embodiment, during a lower power mode such as a sleep mode, the resistor branch (202),(204) is used to provide the reference voltage, while the bandgap (102) is turned off: switch SW1 (212) is closed, and switches SW2 (214) and SW3 (216) are open.

In one embodiment, during a higher power mode such as an active mode, the bandgap (102) is on and used as the reference generator: switch SW1 (212) is open, and switches SW2 (214) and SW3 (216) are closed. Thus, using an integrated scheme, the sleep mode power can be much reduced compared to the conventional method as shown in FIG. 1.

Especially during sleep mode, accuracy of Vout, the regulated voltage at the output of voltage regulator (104), may not be critical and sometimes the only major requirement is that it should be within the standard-cell library working range. By contrast, sleep mode leakage current, due in part to always-on logic, may still be dependent on the Vout level. In general then, the lower Vout, the lower the leakage current will be. In one embodiment, power consumption is further conserved using intermittent calibration to Vout to balance minimizing leakage current while being large enough for the standard-cell library to operate.

Figure 3A:
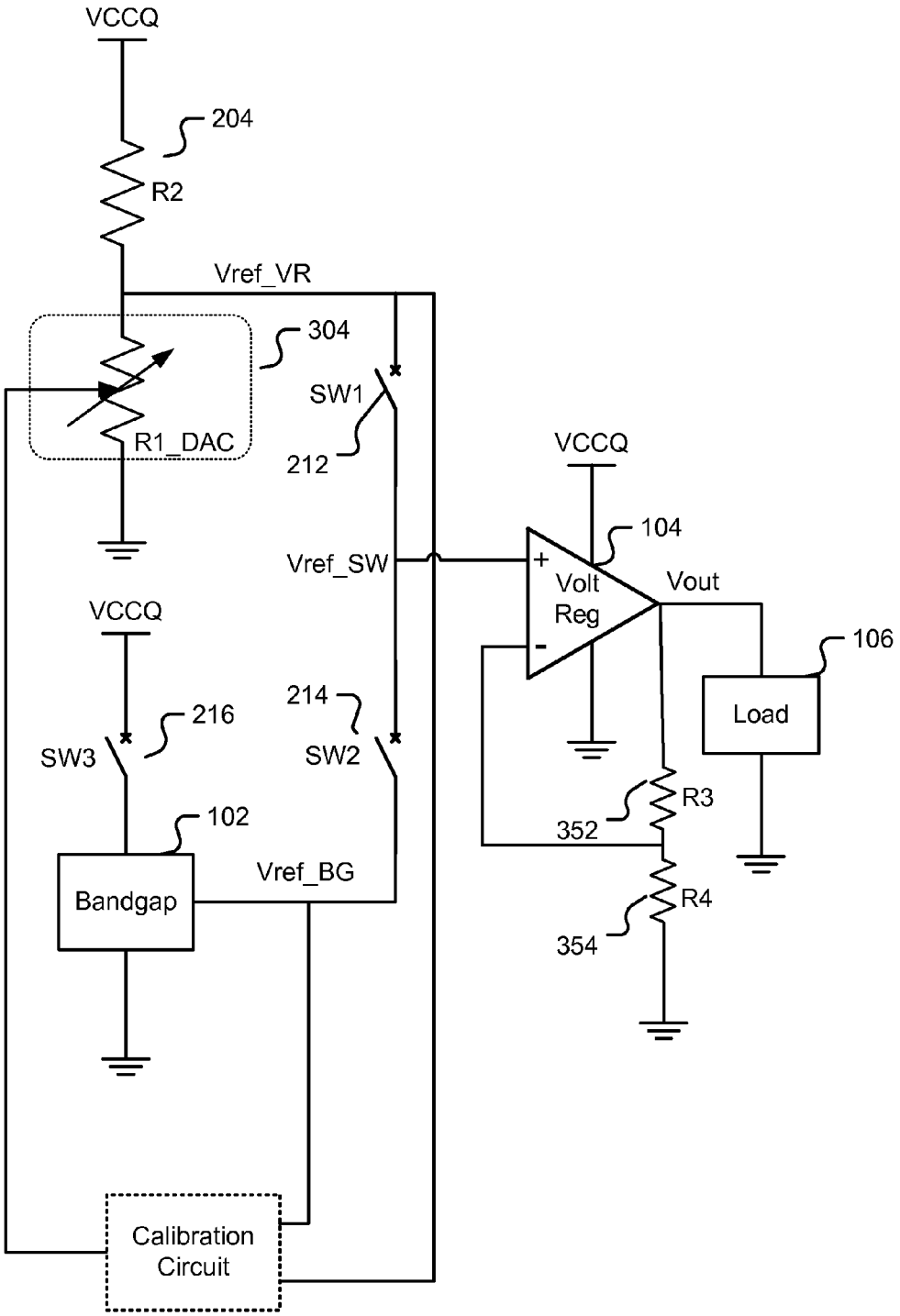
FIGS. 3A and 3B are block diagrams illustrating an embodiment of a system for a low power bias scheme calibration.
Figure 3B:
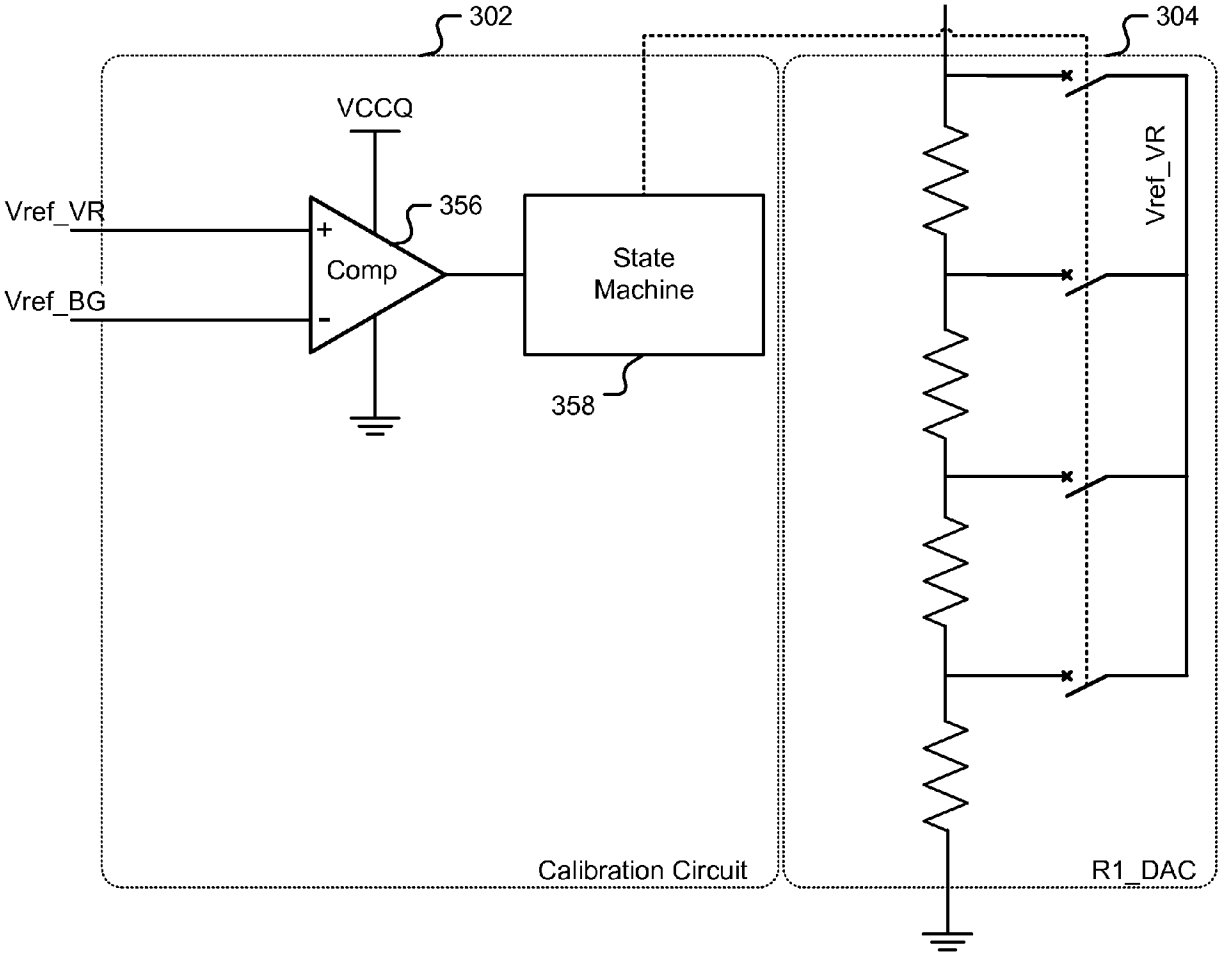

FIGS. 3A and 3B are block diagrams illustrating an embodiment of a system for a low power bias scheme calibration.

In one embodiment, calibration makes Vref_VR in FIG. 3A more accurate. Vref_VR may be calibrated during the active mode when Vref_BG is being used as voltage regulator input reference to make Vref_VR close to Vref_BG. During the sleep mode, the calibrated Vref_VR is intended to allow voltage regulator (104) to output Vout close to that of the active mode level.

FIG. 3A may thus be compared with FIG. 2 to show the addition of a calibration circuit (302) which calibrates an adjustable resistive digital-to-analog converter (DAC), R1_DAC (304) that replaces the static R1 (202) in FIG. 2. In one embodiment, a switch (not shown) may cut power to the calibration circuit (302) itself.

A resistor divider including resistor R3 (352) and resistor R4 (354) is used to scale Vout, such that:

$$V_{out} = V_{ref_BG}\left(1 + \frac{R3}{R4}\right), \text{ in active mode} \tag{3}$$

or $$V_{out} = V_{ref_VR}\left(1 + \frac{R3}{R4}\right), \text{ in sleep mode.} \tag{4}$$

After calibration, the calibration circuit intends to set:

$$V_{ref_VR} = VCCQ\frac{R1}{R1 + R2} \cong V_{ref_BG} \tag{5}$$

For additional leakage current reduction, R4, and in some cases R3, may be adjusted during sleep mode, such that the Vout level is lowered further.

FIG. 3B shows the detail of the calibration circuit (302) in FIG. 3A. Calibration circuit (302), a voltage comparator (356) powered by VCCQ and with common ground, and a digital state machine (358). R1_DAC (304) is comprised of a resistor network with multiple taps with output Vref_VR.

In one embodiment, when calibration mode is executing, the calibration engine and/or digital state machine (358)

compares Vref_VR with the output of the bandgap (102) Vref_BG, and consequently selects a suitable tap in R1_DAC (304), such that Vout is closest to the desired target value as shown in equations (3), (4), and (5). The number of taps in R1_DAC (304) can be used to achieve the desired calibration resolution.

In one embodiment, the calibration circuit is turned off during sleep mode, and R1_DAC (304) consumes the same amount of current as the resistor R1 (202) in FIG. 2. Thus a calibration scheme has equal power consumption as the simple resistor reference voltage generation scheme in FIG. 2 with the improvement of a more accurate regulator voltage, Vout, via calibration during the active mode.

In one embodiment, after the resistor divider reference is calibrated the subsequent sleep mode regulator voltage is set more aggressively low to further reduce the leakage current, while maintaining sufficient voltage margin for the digital circuit to work properly.

Figure 3C:
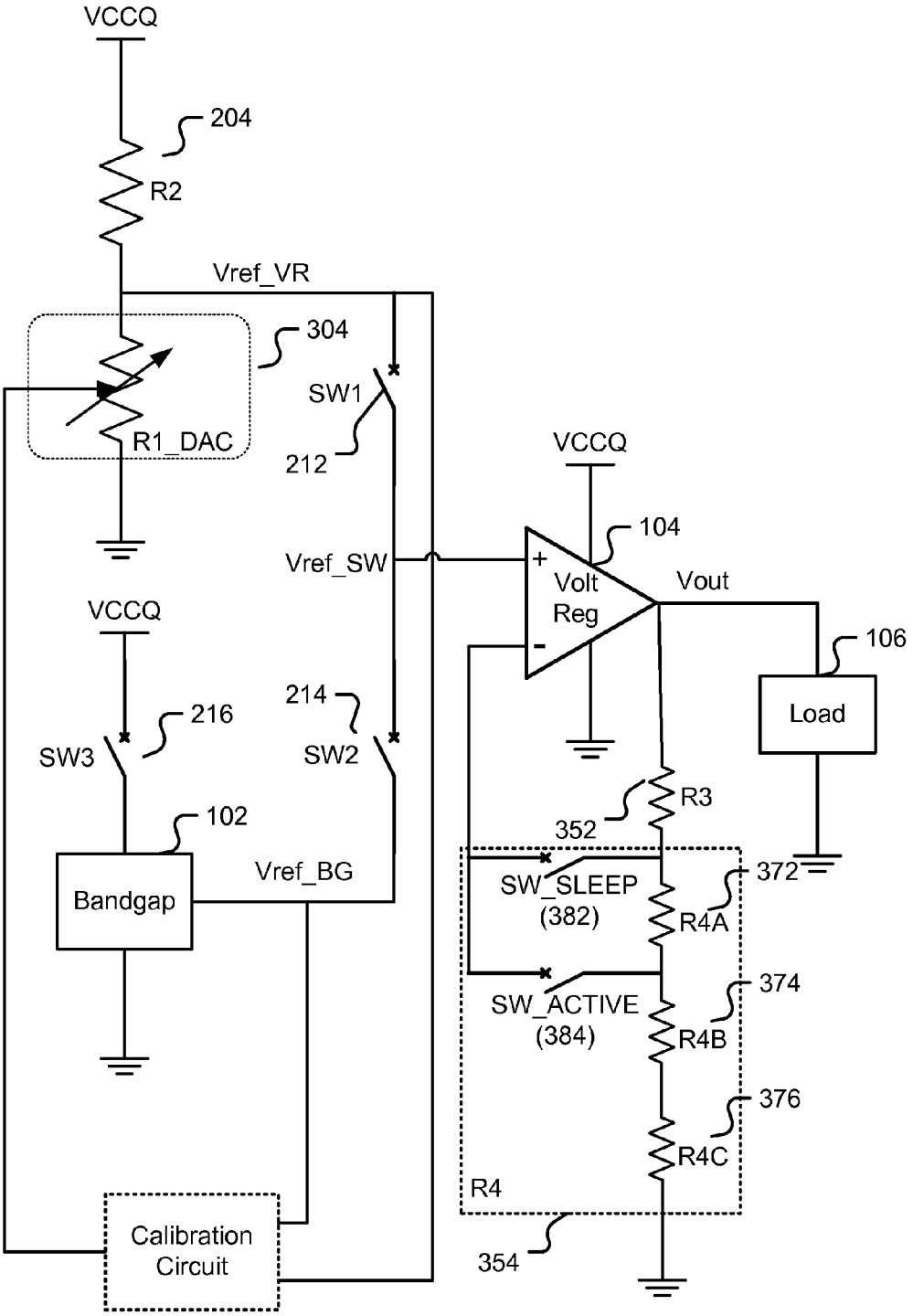
FIG. 3C is a block diagram illustrating an embodiment of a system for a low power bias scheme calibration with adjustable leakage current.

FIG. 3C is a block diagram illustrating an embodiment of a system for a low power bias scheme calibration with adjustable leakage current.

In one embodiment, to lower Vout during sleep mode, the R4 (354) in FIG. 3A is made up of three adjustable resistors: R4A (372), R4B (374), and R4C (376), as well as two switches: Switch SW_SLEEP (382) to tap the voltage divider between R3 and R4A+R4B+R4C, and switch SW_ACTIVE (384) to tap the voltage divider between R3+R4A and R4B+R4C. Thus:

$$V_{OUT} = V_{ref_BG}\left(1 + \frac{R3 + R4A}{R4\{\text{SW_ACTIVE}\}}\right) = V_{ref_BG}\left(1 + \frac{R3 + R4A}{R4B + R4C}\right), \quad \text{in active mode} \tag{6}$$

$$V_{OUT} = V_{ref_BG}\left(1 + \frac{R3}{R4\{\text{SW_SLEEP}\}}\right) = V_{ref_BG}\left(1 + \frac{R3}{R4A + R4B + R4C}\right), \quad \text{in sleep mode} \tag{7}$$

After calibration, Vref_VR=Vref_BG, thus Vout under sleep mode can be designed to be less than Vout under active mode using equations (6) and (7). The sleep mode Vout may be designed precisely by choosing proper values for R4A (372), R4B (374), and R4C(376). A relationship between the two:

$$V_{OUT}\{\text{active}\} - V_{OUT}\{\text{sleep}\} = R4A\left(\frac{R3 + R4A + R4B + R4C}{(R4B + R4C)(R4A + R4B + R4C)}\right) \tag{8}$$

demonstrates that Vout for active mode is greater than Vout for sleep mode, as long as R4A is greater than zero.

Figure 4:
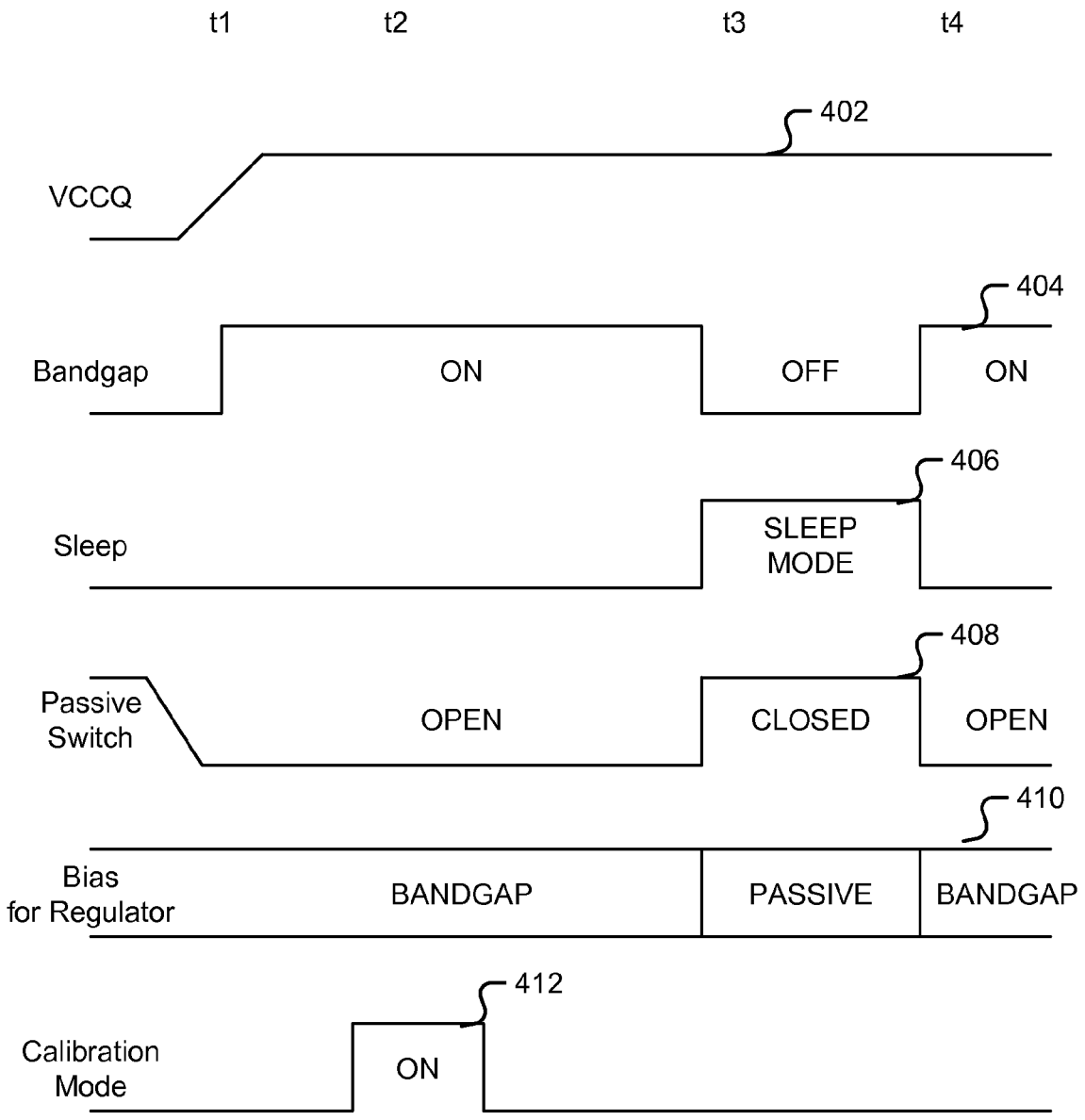
FIG. 4 is a timing diagram illustrating a sequence of events from cold start to active mode to sleep mode to warm start.

In practice, sleep mode bias current may be lowered from, for example 31 uA using a bandgap reference (102) as shown in FIG. 1, to 4 uA using R1_DAC (304) as shown in FIGS. 3A and 3B while the total sleep mode current was less than 100 uA. This represents around a 27% saving in power consumption.

FIG. 4 is a timing diagram illustrating a sequence of events from cold start to active mode to sleep mode to warm start.

Throughout this specification a cold start refers to any start when all circuitry is being powered on. Throughout this specification a warm start refers to any start when at least one circuit is already powered prior to the warm start. An example of a warm start is a start when coming out of sleep mode.

The timing of VCCQ (402) which powers both active circuits (102) and passive bias circuits (202)/(304) and the load (106) shows a cold start at time t1. On cold start the active circuit/bandgap (102) as shown in timing waveform (404) is used to provide bias to the voltage regulator (104) for load (106). The switches to the passive circuitry (212) are set to "open" and/or leave the passive network unattached to the rest of the system as shown in timing waveform (408). As shown in timing waveform (410), the bandgap (102) is used as the bias voltage input for the regulator (104).

Shortly after cold start at time t2, the calibration circuit (302) is activated to perform calibration on the passive circuits (204)/(304), as shown in timing waveform (412).

At time t3 the system is put into sleep mode, as shown in timing waveform (406). The passive switches (212) are closed (408) and/or the passive network is now used (410) to provide the bias for the voltage regulator (104). The bandgap (102) is disconnected and powered down (404) providing savings and efficiency in power consumption.

At time t4 the system goes through a warm start and comes out of sleep mode (406). The passive switches (212) are opened (408) and/or the active bias is now used (410), (404).

Figure 5:
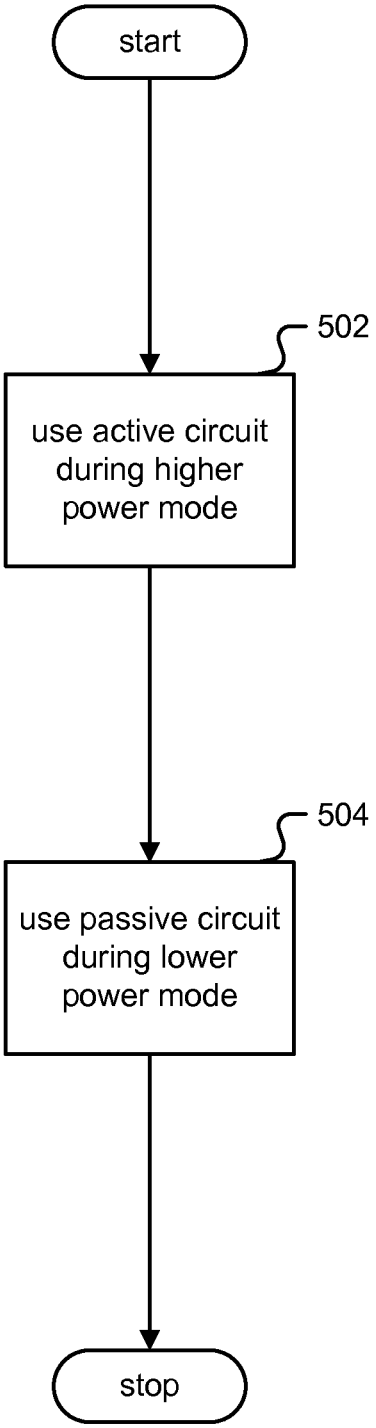
FIG. 5 is a flow chart illustrating an embodiment of a process for lower power bias scheme.

FIG. 5 is a flow chart illustrating an embodiment of a process for lower power bias scheme. In one embodiment, the process of FIG. 5 at least in part uses the circuits in FIG. 2 and/or FIG. 3. In one embodiment, the load (106) is an eMMC.

In step 502, an active circuit is used during higher power mode to supply a reference signal as an input to a voltage regulator. In one embodiment, the active circuit is a bandgap circuit. Throughout this specification, an active circuit is any circuit that relies at least in part on the use of transistors as controlling elements.

In step 504, a passive circuit is used during a lower power mode to supply a second reference signal as the input to the voltage regulator during a lower power mode, wherein the lower power mode consumes less power than the higher power mode. Throughout this specification, a passive circuit is any circuit that does not relay on transistors as controlling elements. In one embodiment, the passive circuit is a voltage divider circuit and/or a resistor network.

In one embodiment, a calibration circuit (302) is coupled to both the active circuit and the passive circuit, and/or configured to calibrate the passive circuit during a higher power mode. Examples of calibrating the passive circuit includes determining a value for a tunable resistor in the passive resistor for a voltage divider, tuning any value for the next time the system is in a lower power mode, scaling an output of a voltage regulator and comparing it to an active circuit using a state machine, and other way of determining a value for a tunable passive component in the passive circuit. In one embodiment, a state machine uses a sequential linear search to determine a value for the passive circuit. In one embodiment, a state machine uses a binary search, for example from most significant bit (MSB) to least significant bit (LSB), to determine a value for the passive circuit. For an N-bit DAC, the linear search would take maximum $2^N$ cycles, while the binary search will take fixed N cycles to perform the calibration. The choice usually depends on the number of bits N and the desired calibration time. In one embodiment, the active circuit and/or calibration circuit is powered down in the lower power mode.

Although the foregoing embodiments have been described in some detail for purposes of clarity of understanding, the invention is not limited to the details provided.

There are many alternative ways of implementing the invention. The disclosed embodiments are illustrative and not restrictive.

What is claimed is:

1. A system, comprising:

a voltage regulator;

an active circuit which supplies a reference signal as an input to the voltage regulator during a higher power mode;

a passive circuit which supplies a second reference signal as the input to the voltage regulator during a lower power mode, wherein the lower power mode consumes less power than the higher power mode, and the lower power mode is off when the higher power mode is on;

an output scaler adjusting an output of the voltage regulator in accordance with power modes including the higher power mode and lower power mode, and a scaled output of the voltage regulator is fed back to the voltage regulator, wherein the scaled output at the lower power mode is lower than the scaled output at the higher power mode; and a calibration circuit, the calibration circuit is coupled to both the active circuit and the passive circuit, and configured to calibrate during the higher power mode and be turned off during the lower power mode.

2. The system recited in claim 1, wherein the active circuit is a bandgap circuit.

3. The system recited in claim 1, wherein the passive circuit is one or more of the following: a voltage divider circuit, and a resistor network.

4. The system recited in claim 1, further comprising an embedded multimedia controller (eMMC), wherein the eMMC is coupled to the output of the voltage regulator.

5. The system recited in claim 1, wherein calibrating comprises determining a value for a tunable passive component in the passive circuit.

6. The system recited in claim 5, wherein the tunable passive component comprises a tunable resistor for a voltage divider.

7. The system recited in claim 5, wherein the value is set for next time the system is in the lower power mode.

8. The system recited in claim 5, wherein determining the value includes scaling an output of the voltage regulator and comparing it to the active circuit using a state machine.

9. The system recited in claim 8, wherein the state machine uses a sequential linear search.

10. The system recited in claim 8, wherein the state machine uses a binary search.

11. The system recited in claim 8, wherein the state machine uses a binary search from MSB to LSB.

12. The system recited in claim 1, wherein the lower power mode is a sleep mode.

13. The system recited in claim 12, wherein the active circuit is powered down in the sleep mode.

14. The system recited in claim 13, wherein the calibration circuit is powered down in the sleep mode.

15. A method, comprising:

using a voltage regulator;

using an active circuit which supplies a reference signal as an input to the voltage regulator during a higher power mode;

using a passive circuit which supplies a second reference signal as the input to the voltage regulator during a lower power mode, wherein the lower power mode consumes less power than the higher power mode, and the lower power mode is off when the higher power mode is on;

using an output scaler adjusting an output of the voltage regulator in accordance with power modes including the higher power mode and lower power mode, and a scaled output of the voltage regulator is fed back to the voltage regulator, wherein the scaled output at the lower power mode is lower than the scaled output at the higher power mode; and using a calibration circuit, the calibration circuit is coupled to both the active circuit and the passive circuit, and configured to calibrate during the higher power mode and be turned off during the lower power mode.

16. The method of claim 15, wherein the lower power mode is a sleep mode.

17. The method of claim 16, wherein the active circuit is powered down in the sleep mode.

* * * * *